US005564408A

United States Patent [19]

Bassols

[11] Patent Number: 5,564,408

[45] Date of Patent: Oct. 15, 1996

[54] PAVEMENT TREATMENT METHOD AND APPARATUS

[76] Inventor: Luis Bassols, 4630 NW Grand Ave., Base 5, Glendale, Ariz. 85301

[21] Appl. No.: 171,111

[22] Filed: Dec. 20, 1993

[51] Int. Cl.[6] ..... B28D 1/04

[52] U.S. Cl. ..... 125/12; 451/344; 451/353

[58] Field of Search ..... 125/12; 51/170 R, 51/170 PT, 174, 176, 267, 273; 30/379, 388, 390, 516; 83/168, 860; 451/344, 350, 352, 353, 358, 359

[56] References Cited

U.S. PATENT DOCUMENTS

| | | | |
|---|---|---|---|
| 2,562,396 | 7/1951 | Schutz | 51/273 |
| 3,624,967 | 12/1971 | Kamper et al. | 51/425 |
| 3,882,598 | 5/1975 | Earle et al. | 51/273 |
| 4,022,182 | 10/1977 | Lenkevich | 51/273 |
| 4,051,880 | 10/1977 | Hestily | 51/273 |
| 4,620,367 | 11/1986 | Tubesing et al. . | |
| 4,778,304 | 10/1988 | Baldi et al. | 30/379 |
| 4,894,959 | 1/1990 | Hoover | 51/425 |
| 5,074,044 | 12/1991 | Duncan et al. | 30/390 |
| 5,167,215 | 12/1992 | Harding, Jr. | 51/273 |
| 5,305,729 | 4/1994 | Chiuminatta et al. | 125/12 |

*Primary Examiner*—Maurina T. Rachuba
*Attorney, Agent, or Firm*—Poms, Smith, Lande & Rose, P.C.

[57] ABSTRACT

An improved pavement treatment apparatus and method are disclosed, for example for concrete and asphalt saws, which may include a vacuum apparatus for removing water and slag. The apparatus also may include an improved blade guard and a pump system for removing the collected water and slag solution.

41 Claims, 8 Drawing Sheets

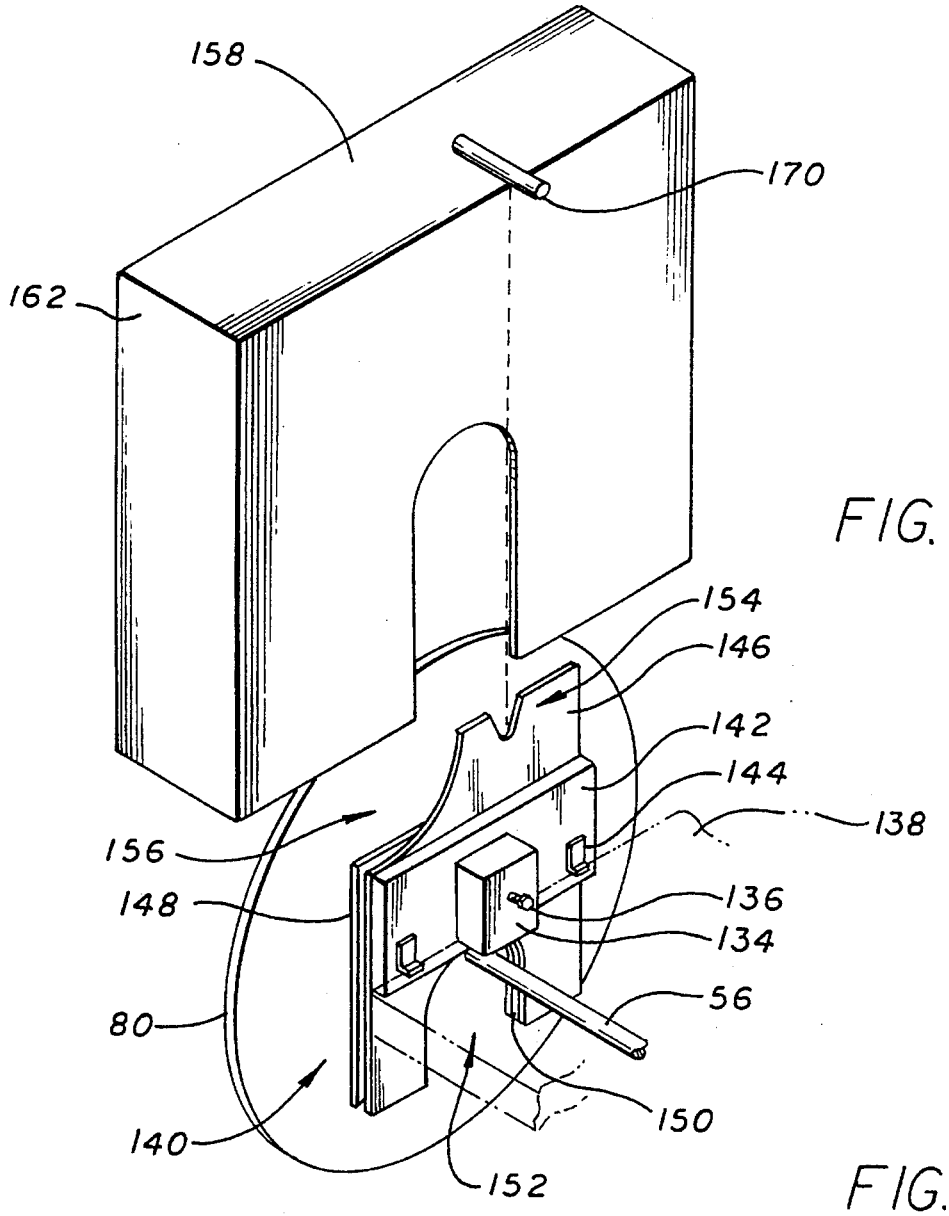
FIG. 5
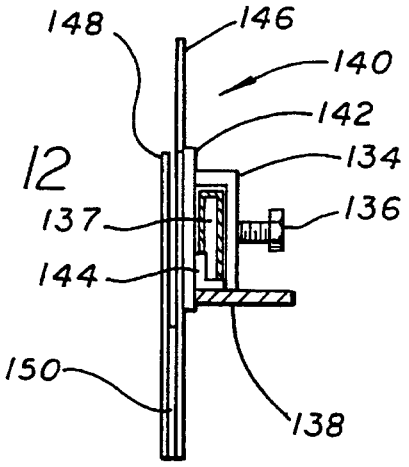
FIG. 12
FIG. 11
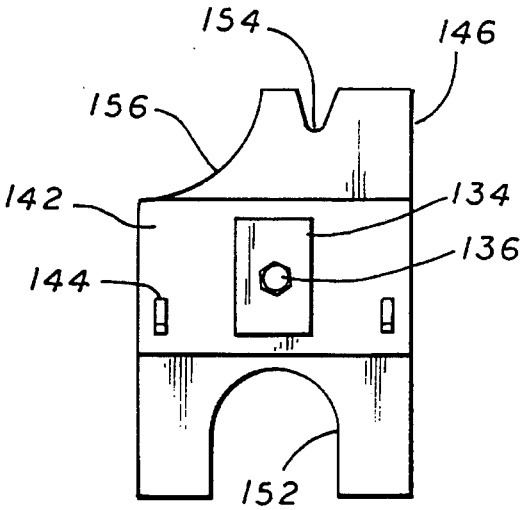

FIG. 13
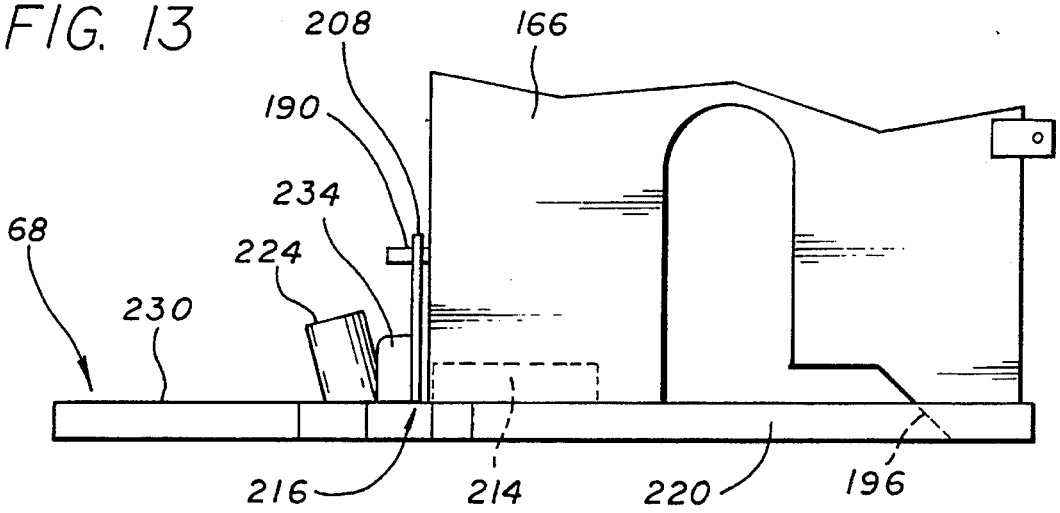
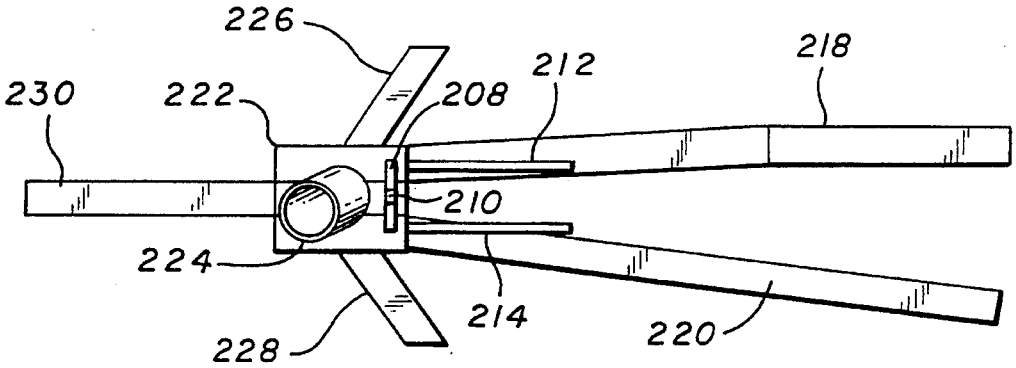
FIG. 14
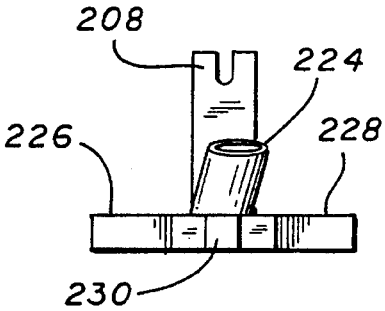
FIG. 15
FIG. 16
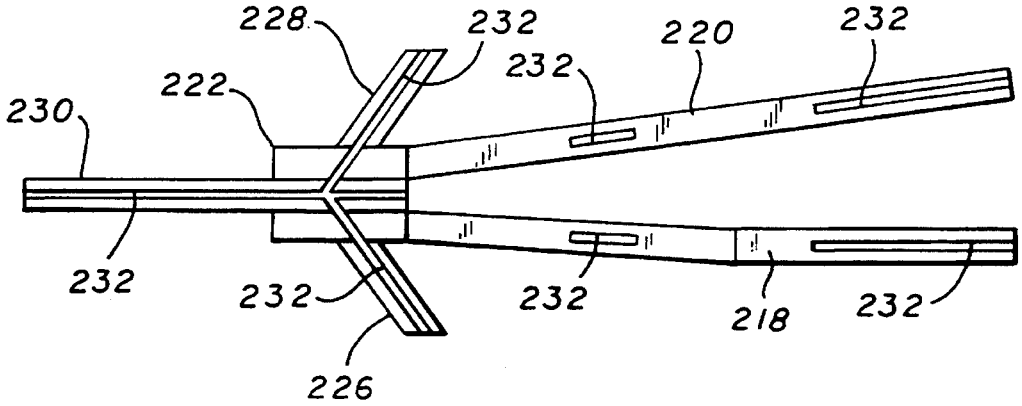

FIG. 20
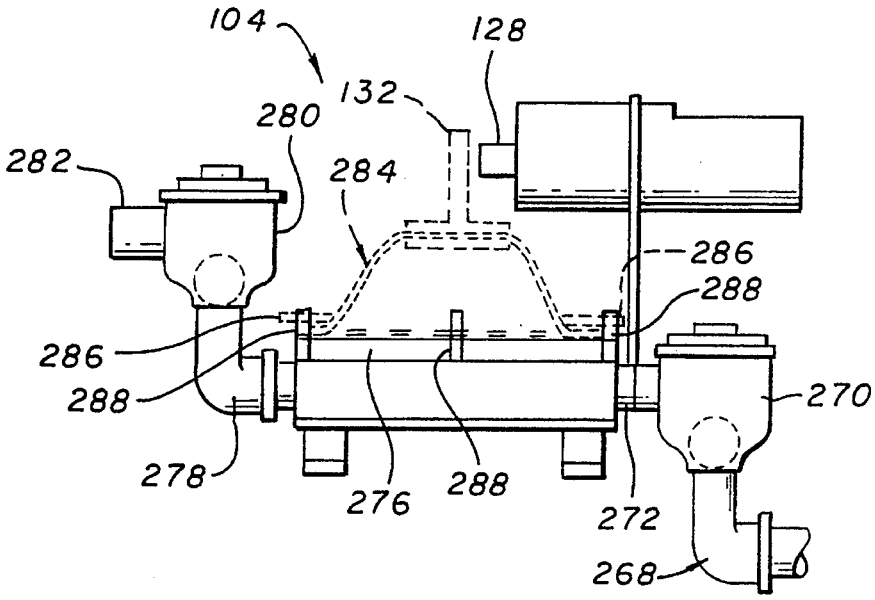
FIG. 21
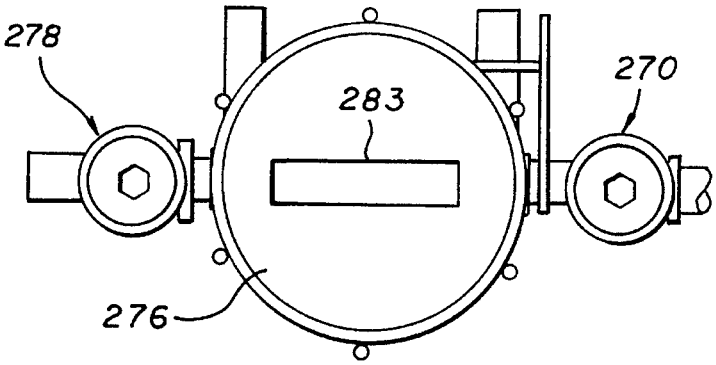
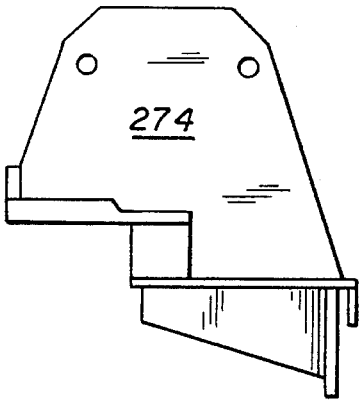
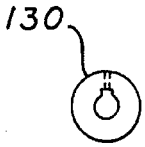
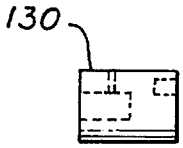
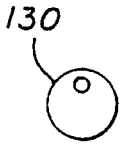
FIG. 24A FIG. 24B FIG. 24C FIG. 25
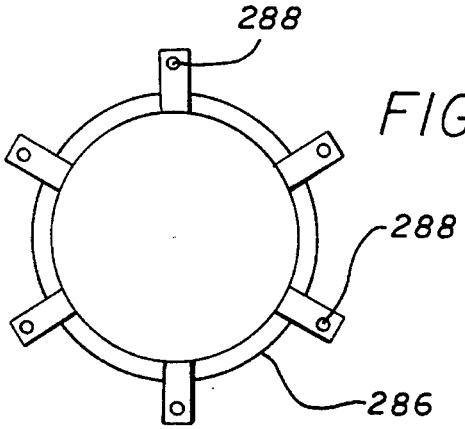
FIG. 23
FIG. 22
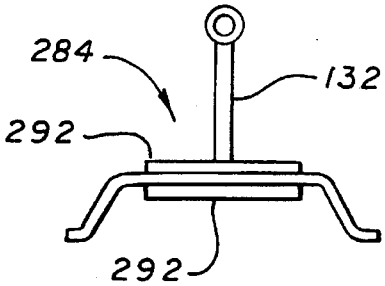

PAVEMENT TREATMENT METHOD AND APPARATUS

BACKGROUND OF THE INVENTION

1. Field of the Invention

The present invention relates generally to methods and apparatus for treating pavement, such as, for example, concrete and asphalt saws.

2. Related Art

Concrete and asphalt saws are typically used to cut joints for expansion and contraction of such materials in freeway pavement, aircraft runways, and other pavement surfaces. Typical saws are marketed under different brand names and include a diamond blade of different diameters according to the thickness of the pavement to be cut, such as 12, 14, 16, or 24-inch blades, etc., driven by an internal combustion engine. The engine typically includes a dry air filter and/or an oil bath air filter for filtering incoming air prior to mixing for combustion in the engine. The engine is also used to drive a traction mechanism at the rear of the saw for advancing the saw along the pavement. A belt takes power from a pulley driven by the internal combustion engine for powering a transmission box to step down the revolutions per minute (rpm) of the engine to a suitable rate for driving the traction wheels of the saw.

The saw blade includes a semi-circular blade cover for protecting the blade during operation and for preventing injury while the blade is rotating. The blade cover also serves to contain cooling water sprayed onto the blade so that the cooling water drops onto the pavement. The blade guard is substantially circular around the blade. The blade cover is substantially fixed relative to the blade and saw.

The saw also includes a structural support frame for supporting all of the components and for mounting the wheels to the saw. The frame supports the engine, the shaft for driving the saw blade, the traction transmission and the pulleys for powering the traction transmission from the engine, among other elements.

In operation, the saw is started and positioned in alignment with the desired cutting path, and lowered into engagement with the pavement while at the same time turning on the coolant spray to the blade. An additional vehicle is located nearby for supplying water for cooling the blade through a suitable hose. As cutting continues, the water and resulting slurry from the abraded pavement spreads across the pavement, possibly filling previously cut joints. Sand blasting or water blasting has to be used to clean joints filled with such slurries to allow the contraction and expansion work. This procedure contributes to add more unwanted materials that cover the surface of the pavement and will fly away with the traffic or wind, polluting the environment. For environmental and other reasons, operators have begun vacuuming the water/slag slurry using a vacuum truck following along behind the saw to remove the slurry while the slag is still wet. However, such secondary vacuum vehicles require a substantial capital investment, are inefficient and only marginally clean the water and slag from the pavement.

There is a need for a more efficient and practical saw which more effectively contains the water and slag flow from the saw, and a more efficient and effective water and slag removal method and apparatus.

SUMMARY OF THE INVENTION

The present invention provides a more efficient and effective method and apparatus for removing slurry created during pavement treatment operations such as cutting joints, while at the same time more effectively controlling water and slag flow, and a more efficient and effective method and apparatus for removing slag and water from the pavement or other material being treated. In accordance with the present invention, a pavement treatment apparatus such as a saw incorporates a solution pickup such as a vacuum for picking up water and slag as soon as the slurry is created from the saw and also as soon as the water is no longer usable for cooling the saw blade. In one preferred embodiment, a pavement saw includes a vacuum arrangement for removing water and slag from the pavement being treated, wherein the slag/water removal is accomplished by a vacuum system operated off of the carburetion system on an internal combustion engine already used on the saw. In a further preferred form of the invention, an effective vacuum bar or vacuum shoe is positioned about the saw blade to remove any water and slag which is created through operation of the saw. Vacuum is applied to the vacuum bar through an intermediate separator or collection tank to which vacuum is applied from the carburetion system of the engine and into which the water/slag solution is placed. Moreover, a pump can be applied to the saw, and may be driven from the internal combustion engine, for pumping the water/slag combination from the collection tank, for example, to a secondary holding tank on the same vehicle which holds water for cooling the saw blade.

In another form of the invention, an efficient vacuum pump is used to pump the water/slag solution from the collection tank to the holding tank. The preferred vacuum pump includes a diaphragm placed over an opening in the conduit from the separator tank to the secondary holding tank on the truck. The diaphragm pulls the solution from the separator tank through a check valve on a suction stroke, and pushes the solution through the conduit toward the secondary holding tank on the pump stroke. The described embodiment is efficient, simple to construct and use and easy to maintain.

In another form of the invention, an improved saw blade cover or blade guard floats relative to the saw at a substantially constant distance from the pavement. Additionally, the preferred blade guard has a substantially rectangular configuration to damp or stop the propagation of water jets created through rotation of the saw blade. The blade guard channels water and slag toward the vacuum bar, such as one described above, and includes an opening for easier viewing of the blade during operation of the saw. In the preferred embodiment, the blade guard also includes a replaceable front wall (or other impacted wall) to permit easy replacement of a worn wall resulting from abrasion by water and slag.

It is, therefore, an object of the present invention to provide a pavement treatment apparatus and method which is more efficient, compact, easy to assemble and maintain, and constitutes a more complete pavement treatment apparatus and method.

It is also an object of the present invention to provide an improved pavement treatment apparatus and method which can also remove water and slag, thereby conserving water, more effectively controlling use and loss of water and more effectively removing resultant slurry.

It is a further object of the present invention to provide a pavement treatment apparatus and method having a water and slag removal system such as a vacuum system which provides a potential for conserving water, is more cost effective than current systems, is easily retrofit to existing saws and removes environmentally undesirable slurry.

It is another object of the present invention to provide a slag and water removal apparatus and method which uses a simple and efficient waste pump which can easily handle the water and slag solution, and which can be easily operated with the pre-existing saw engine.

It is a further object of the present invention to provide a pavement treatment apparatus having an improved guard, such as a blade guard for a pavement saw, which improves water containment, floats with respect to the blade, permits easier blade viewing during operation, and controls cooling water flow after the water is ejected from the saw-blade surface.

These and other objects of the present invention will become more apparent from consideration of the drawings, a brief description of which is provided below, as well as from consideration of the detailed description of the preferred embodiments.

BRIEF DESCRIPTION OF THE DRAWINGS

FIG. 5 is an inside perspective and exploded view of a blade guard in accordance with one aspect of the present invention with a support for use with a pavement saw.

FIG. 11 is an inner side or left-side plan view of the blade guard support of FIG. 5.

FIG. 12 is a front-elevation view of the blade guard support of FIG. 5.

FIG. 13 is a side view of the blade guard having a vacuum bar mounted to the blade guard in accordance with one aspect of the present invention.

FIG. 14 is a top-plan view of the vacuum bar of the FIG. 13.

FIG. 15 is a front-elevation view of the vacuum bar of FIG. 13.

FIG. 16 is a bottom-plan view of the vacuum bar of FIG. 13.

FIG. 20 is a side-elevation view of a diaphragm pump assembly in accordance with a further aspect of the present invention and including a motor for driving the pump.

FIG. 21 is a top-plan view of part of the pump assembly of FIG. 20.

FIG. 22 is an elevation and partial side section of the diaphragm of the pump of FIG. 21.

FIG. 23 is a top plan view of a diaphragm retaining ring for holding a diaphragm pump on the pump assembly of FIG. 20.

FIGS. 24A–C are left, center and right side views of an eccentric bushing for coupling the motor to the diaphragm.

FIG. 25 is a side elevation view of the motor mounting plate for the pump assembly of FIG. 20.

DETAILED DESCRIPTION OF THE PREFERRED EMBODIMENTS

Figure 1:
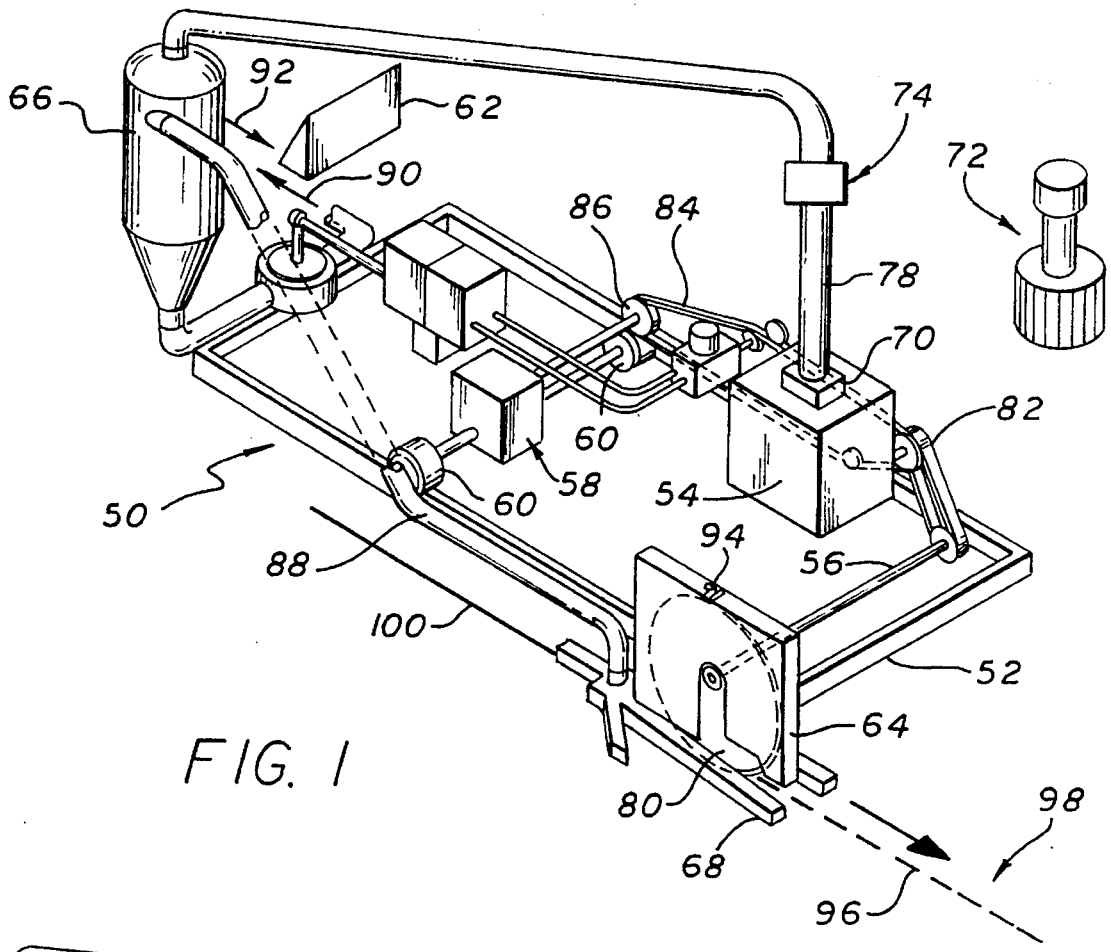
FIG. 1 is a schematic of an exemplary pavement treatment apparatus for use with the present inventions, such as a concrete and asphalt saw.
Figure 2:
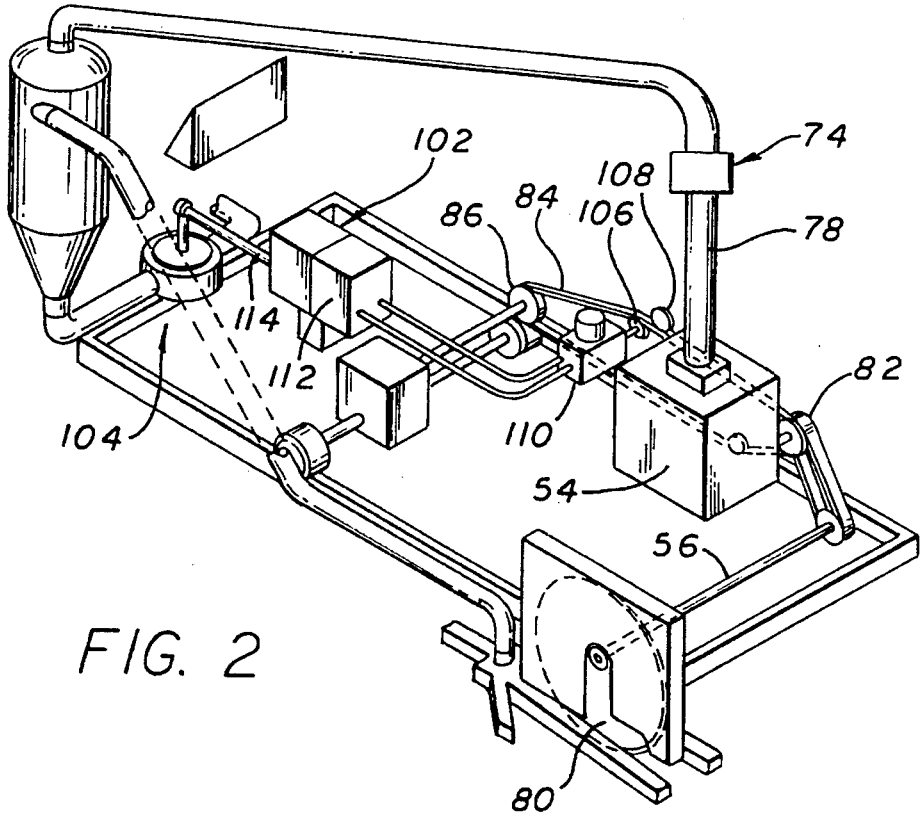
FIG. 2 is a schematic of drive mechanisms for a saw including power take-off for a waste pump system.
Figure 3:
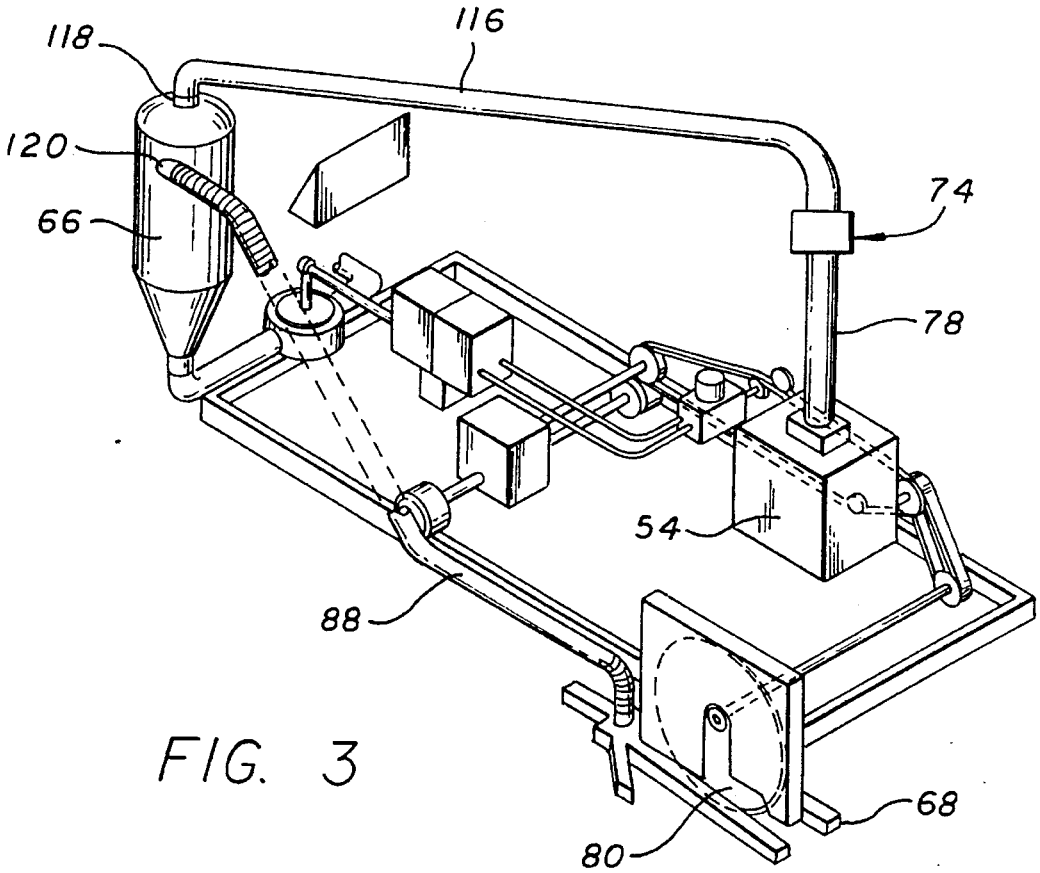
FIG. 3 is a schematic of a vacuum system incorporated into a saw for providing vacuum to a vacuum bar in accordance with the one aspect of the present invention.
Figure 4:
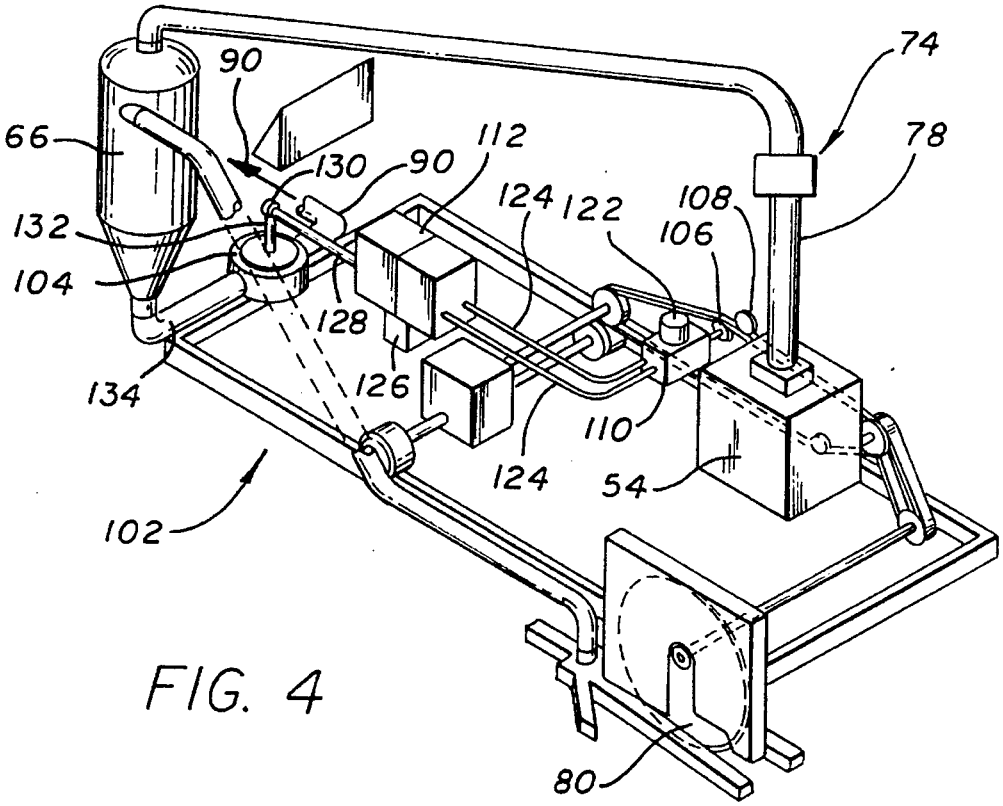
FIG. 4 is a schematic of a waste-pump system for a saw in accordance with another aspect of the present invention for collecting and eliminating waste.

In accordance with the present invention, a pavement treatment method and apparatus is disclosed which provides a more efficient and effective pavement treatment and provides for a more efficient and effective waste removal. In the preferred embodiment, a concrete and asphalt saw 50 includes a chassis or frame 52 for supporting the blade driving mechanism and the saw traction apparatus (FIG. 1). The saw includes an internal combustion engine 54 for driving the saw blade and for powering other elements of the saw. It should be noted that FIGS. 1–4 are schematic and are intended to show relationships between components of the saw and the added elements intended to accomplish the purposes of the present invention. For details of conventional saws, reference should be made to literature describing, or to the structure of, pre-existing saws.

The frame 52 supports a saw drive shaft 56 driven from a pulley which in turn is driven from the engine 54. The frame also supports a traction mechanism 58 including drive wheels 60 for driving the saw forward during pavement cutting or for moving the saw. The frame supports a control panel 62, which includes appropriate switches and levers for controlling blade speed, saw speed, water flow and cutting depth. The frame in one preferred embodiment also supports a blade guard 64 and a collection or separator tank 66, described more fully below. A vacuum bar or vacuum shoe 68 is supported by the blade guard, and therefore is also supported by the frame.

The engine 54 is typically a 2- or 4-cylinder internal combustion engine having a carburetor shown schematically at 70 (or a diesel engine for example having an intake manifold) to which is coupled a dry filter air intake 72 and/or an oil bath filter air intake 74. The filter(s) are arranged in such a manner that the air for mixing with the fuel for the engine comes directly from the collection tank 66 through the filter, which also serves to apply a vacuum from the air intake 78 to the separator tank 66.

The drive shaft 56 extends to the right side (as viewed from the control panel 62) of the saw for supporting and driving a saw blade 80 for cutting the pavement in a down cut fashion. The drive shaft 56 is driven at the left side of the saw by an engine pulley 82, which in turn drives a drive belt 84 around a take-off pulley 86 for powering the traction mechanism 58.

The separator tank 66 is coupled through an intake port to a waste collection hose 88 which in turn is coupled to the vacuum bar 68 for passing slurry from the vacuum bar to the collection tank 66. A waste disposal hose 90 transports waste from the collection tank 66 through a diaphragm pump 104 (described more fully below) to a tender truck (not shown) typically used to supply water to the saw over a water supply hose 92 depicted schematically in FIG. 1 by an arrow. Water is ultimately supplied to a tee coupling 94 on the blade guard 64 for cooling the blade 80 (FIG. 1).

In operation, the saw 50 is aligned with a marked line 96 representing the joint to be cut in the pavement 98. The saw blade 80 is engaged with the motor and the blade lowered to the pavement to begin cutting after the cooling water is applied to the blade. The blade cuts to the predetermined depth in the pavement and the cutting continues until completed. Cooling water from the blade and slag or debris material produced during the cutting operation falls from inside the blade guard 64 to the pavement and into the cut joint 100 which is picked up by the vacuum bar 68. The vacuum applied from the air intake through the collection tank 66 pulls the slurry from the vacuum bar 68 to the collection tank 66. The wastes settles to the bottom of the collection tank, and is then removed to the waste tender, as described more fully below.

With this improved saw, a more efficient and effective device is provided which can quickly remove waste material as the waste material is created during the cutting operation and which can quickly remove the waste material to another area. The waste removal system is easily adapted to pre-existing saws and does not require any additional vehicles for removing the waste material from behind the saw. The waste removal system is easily adapted to the pre-existing saws and does not require any additional power beyond what is already supplied by the pre-existing engine.

In order to remove waste material from the collection tank 66, a waste pump system 102 (FIG. 2) is provided for pumping the waste from the collection tank 66 to the tender vehicle. The waste pump system includes a diaphragm pump assembly 104, described more fully below, which is ultimately powered through a power take off pulley 106 which engages the drive belt 84 adjacent idler pulley 108. The power take off pulley 106 operates a hydraulic pump 110 which in turn drives a hydraulic motor 112. The hydraulic motor turns a shaft 114, which in turn operates the diaphragm pump 104. The diaphragm pump pulls waste material from the collection tank 66 and pumps the material to the tender vehicle over the hose 90 (FIG. 1). Using the power provided by the engine 54 to pump the waste material from the collection tank does not require a separate power unit in addition to the pre-existing engine 54. The operation of the pump 104 can be independently adjusted through adjustments in the hydraulic pump 110 or the hydraulic motor 112. Therefore, the pump diaphragm 104 can be operated relatively independently of the operation of the engine 54.

In the vacuum system (FIG. 3), the vacuum is taken from the air intake and applied to the collection tank 66 through an air manifold vacuum hose 116 to a vacuum manifold 118 on the top of the collection tank 66. While the engine is running, the pressure in the collection tank 66 is sub-atmospheric thereby creating a vacuum in the vacuum bar 68 through the waste collection hose 88 between the vacuum bar and the inlet 120 to the collection tank. Using the pre-existing vacuum in the air intake manifold to the engine simplifies the vacuum system and the improved saw design. No additional equipment is necessary to create a vacuum for moving the waste product from the area of the saw. The vacuum apparatus is easily retro-fit or applied to pre-existing saws at a relatively low cost and without significant effort.

The waste pump system 102 (FIG. 4) removes waste from the collection tank 66 and pumps the waste to the tender vehicle. In the waste pump system, the power take-off pulley 106 drives the hydraulic pump 110 having a reservoir 122 for the hydraulic fluid. In one embodiment, the hydraulic pump may be a John Barnes model GC1160-BA23DA-DL pump operating at approximately 2,000 rpm. Hydraulic lines 124 connect the hydraulic pump 110 to the hydraulic motor 112 mounted on a motor support 126, preferably attached to a frame element of the saw. The hydraulic motor may be a John Barnes model GC2616-BA17-DL with an internal speed control which may be coupled to an appropriate control on the control panel 62 (FIG. 1). The hydraulic motor operates the diaphragm pump 104. The pump includes a shaft 128 which turns a preferably half-inch eccentric bushing 130 to which is rotatably connected a diaphragm pump rod 132 in a manner to provide a one-inch stroke for each revolution of the shaft 128. The diaphragm pump removes waste from the collection tank 66 through a hose 134 and pumps the waste through the disposal hose 90 to the tender. As with the vacuum system, use of a waste pump system in conjunction with the pre-existing drive mechanism on the saw permits efficient disposal of the waste product, easy assembly of the waste disposal system on pre-existing designs as well as implementation on new saw designs, and also permits easy maintenance. Other motors may be used to operate the pump. For example, the motor may also be an electric gear motor, such as a 12 volt DC motor with an 81:1 gear reduction operating at 40 rpm, Dayton Model 1L471 electric gear motor. Power for the electric gear motor is taken off of the battery system of the saw.

As previously described, the depictions in FIGS. 1–4 are schematic. The means by which the various added components are mounted to the saw may vary depending on preference and by the particular mechanisms by which the components are connected. However, it is preferred, though not necessary, to have the collection tank as close as possible to the vacuum bar and the pump coupled as close as practicable to the outlet of the collection tank. Also the various added elements may be mounted more or less directly to the support structure of the saw, depending on weight and moment considerations for properly supporting the additional components.

The blade guard and blade guard support (FIGS. 5–12) are mounted through a mounting bracket 134 (shown partially cut-away in FIG. 12) and a mounting bolt 136 to an upright post 137 (FIG. 12) mounted or welded to the bottom 138 of the saw or to a portion of the frame of the saw. For example, it is contemplated that the post may be mounted through bolts that are used to support the bearing for the saw adjacent the blade. A blade guard support 140 is supported by the mounting bracket through a mounting plate 142, which provides structural integrity to the blade guard support. A pair of stops 144 are spaced an equal distance from each side of the mounting bracket 134 for stabilizing the blade guard support on the frame so that the mounting bracket cannot tilt front to back on the post 137.

The blade guard support 140 is formed from an inner plate 146 spaced apart approximately 3/16 of an inch from an outer plate 148 and bonded together by a weld 150 about an arch or cut 152 formed in both the inner and outer plates. The internal portion of the opening 152 provides clearance for and accommodates the drive shaft for the saw blade, and the external surface of the weld 150, i.e. that portion of the weld which can be touched only be going between the plates 146 and 148, accepts and guides the blade guard through a complimentary arched opening in the blade guard 64. The weld 150 is preferably approximately ⅜ of an inch thick to provide sufficient structural integrity for engagement with the blade guard.

The top portion of the top edge of the inner plate 146 includes a diverging U-shaped notch 154 for supporting the blade guard when the saw is to be picked up, namely when the saw blade is lifted more than one inch from the pavement. An arcuate cut 156 is formed in the forward portion of the inner plate.

The blade guard 64 (FIGS. 5–10) includes a top side 158, a rear side 160, a front side 162, an inner side 164 and outer side 166, and is preferably a rectangular parallelopiped for the part of the blade guard having sides. The front side 162 faces in the forward direction of movement of the saw. The outer side 166 faces outward relative to the saw, and the inner side 164 is adjacent to the remainder of the saw. The blade guard preferably includes two handles 168 for assembling, adjusting and positioning the blade guard and its attached vacuum guard (described more fully below). The blade guard also includes a pick-up rod 170 transversely across the top side 158 of the blade guard a sufficient distance over the mounting plate 142 so as to fall into the U-shaped groove 154 and be picked up by the blade guard support 140 when the saw is picked up more than one inch. The pick-up rod 170 engages the groove whenever the blade is one inch or more above the pavement. Since the blade guard support 140 is mounted to the frame, lifting of the blade of the saw away from the pavement more than one inch moves the blade guard support 140 upward relative to the blade guard until such time as the pick-up rod 170 engages the groove 154. The dimensions are determined in such a way that the pick-up rod 170 engages the bottom of the U-shaped groove 154 when the blade is one inch above the pavement. When the blade is less than one inch above the pavement the blade guard and vacuum bar float relative to the saw so that the vacuum bar and blade guard stay relatively close to the pavement, as determined by the positioning of the wheels mounted to the blade guard, described more fully below, thereby permitting pick up of the waste material.

A pipe tee 172 (FIGS. 6 and 10) is mounted transversely to the top side 158 of the blade guard to provide a coupling for the water supply hose 192 from the tender to distribute water to the blade for cooling. A pair of elbows 174 are coupled to each side of the pipe tee to enable a hose 176 to be coupled between the pipe tee and a second set of elbows 178 threaded into openings 180 in respective sides of the blade guard. The elbows 178 include stainless steel veejet nozzles 182 threaded internally into the elbows 178 so as to more uniformly spread water on each side of the blade. The veejet nozzles 182 more efficiently cool the saw blade and conserve consumption of water.

A pair of wheels 184 is mounted to respective sides and opposite end portions of the blade guard for supporting the blade guard on the pavement, and through engagement with the vacuum bar, for supporting the vacuum bar at a relatively constant spacing from the pavement. The wheels 184 are mounted on respective pins 186, and the positioning of the wheels on the pavement with respect to the blade guard is made through adjustment bolts 188 mounted adjacent the respective front and rear sides of the blade guard. The wheel positioned adjacent the rear side of the blade guard is offset an appropriate amount in order to accommodate the waste collection hose 88, and extends far enough rearward that part of the vacuum bar may extend in front of and outwardly to the side of the wheel. The wheel mounted adjacent the forward portion of the blade guard is positioned so as not to interfere with the front of the saw or the front portion of the vacuum bar.

The rear side 160 includes a threaded vacuum bar mounting bolt 190 approximately 3 and ¾ inches above the bottom of the rear portion of the blade guard. The vacuum bar is mounted to the bolt 190 through an appropriate threaded fastener so that the vacuum bar is supported by the blade guard and moves vertically with the blade guard.

Some exemplary dimensions will be provided for the blade guard, as well as for other components described herein, so as to demonstrate the relative dimensions of the parts. For example, for a 12, 14 or 16 inch blade, the blade guard 64 may be 17 inches high by approximately 17 and ½ inches long, from front to rear. On the inner side 164 of the blade guard, the side is partially bisected by a four and a half inch wide cut terminating approximately ten inches above the lower-most side in a semi-circle to accommodate the drive shaft for the blade, as well as to engage the welded portion of the blade guard support 140. The forward most portion of the inner side 164 is preferably 17 inches top to bottom whereas the rearward most portion is preferably 16 inches top to bottom, so that the rearward most portion of the blade guard fits and rests on top of the vacuum bar, and so that the forward most portion of the blade guard fits inside spaced apart legs of the vacuum bar, as describe more fully below. The inner and outer sides are preferably formed from 3/32 inch sheet metal while the rear most side 160 is formed from ¼ inch sheet metal to support the vacuum bar.

The outer facing side 166 of the blade guard also includes a 3¾ inch cut formed in the lower portion of the side terminating approximately 7 inches from the top of the blade guard in a semi-circle. The 3¾ inch cut accommodates the shaft on the saw blade. The lower front portion of the outer wall 166 includes a cut 192 formed therein for purposes of allowing viewing of the blade during operation. The cut includes an angled surface 194 extending from the upper portion of the cut extending forwardly and downwardly to the bottom most edge 196 of the outer side of the blade guard. The top to bottom height of the outer side to the bottom-most edge 196 is preferably 17 inches. The height of the cut is preferably 2¼ and starts 3 inches from the arched cut.

Figure 6:
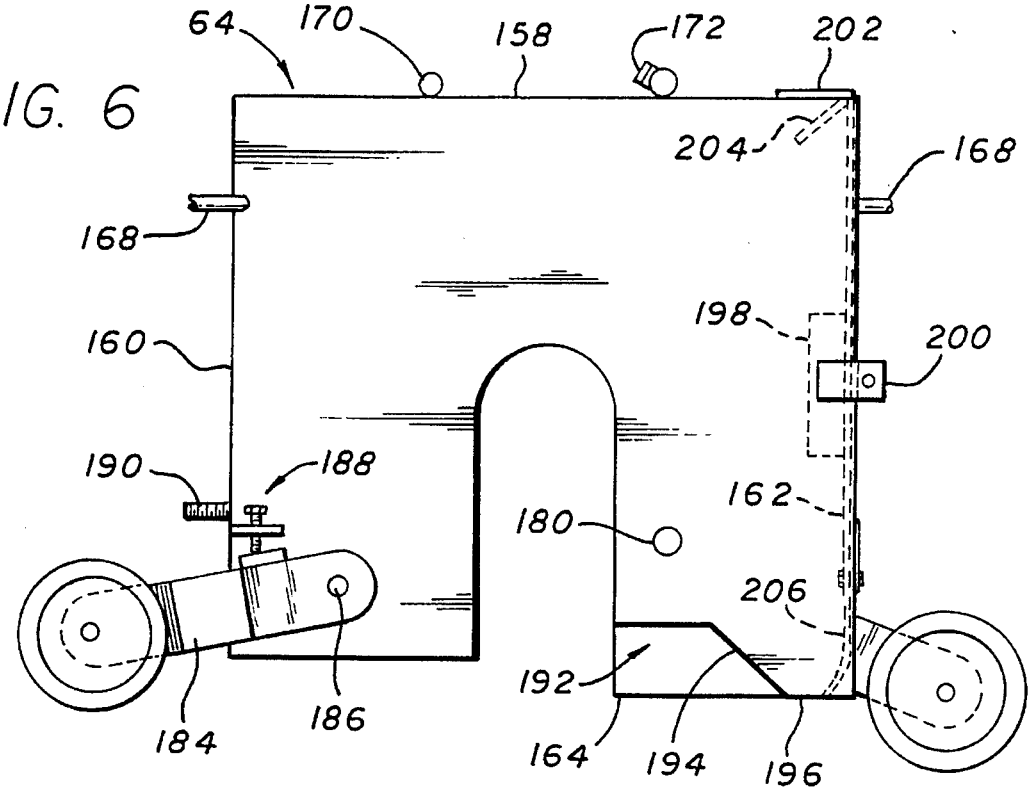
FIG. 6 is an outside or right-side elevation view of the blade guard in accordance with one aspect of the present invention.
Figure 7:
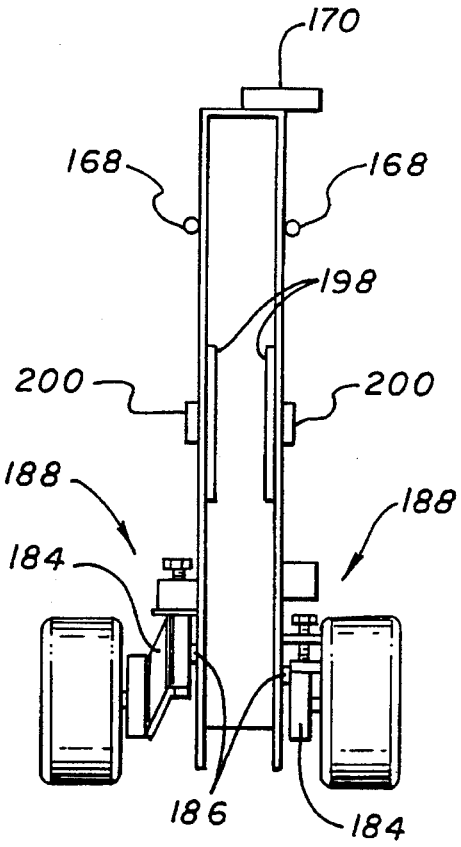
FIG. 7 is a front elevation view of the blade guard of FIG. 5.
Figure 9:
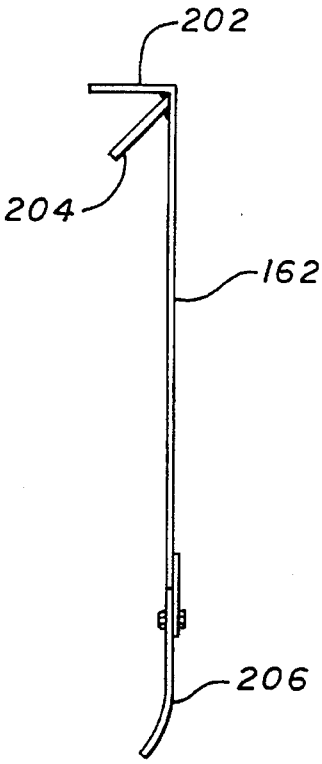
FIG. 9 is a side elevation view of a front cover for the blade guard of FIG. 5.
Figure 8:
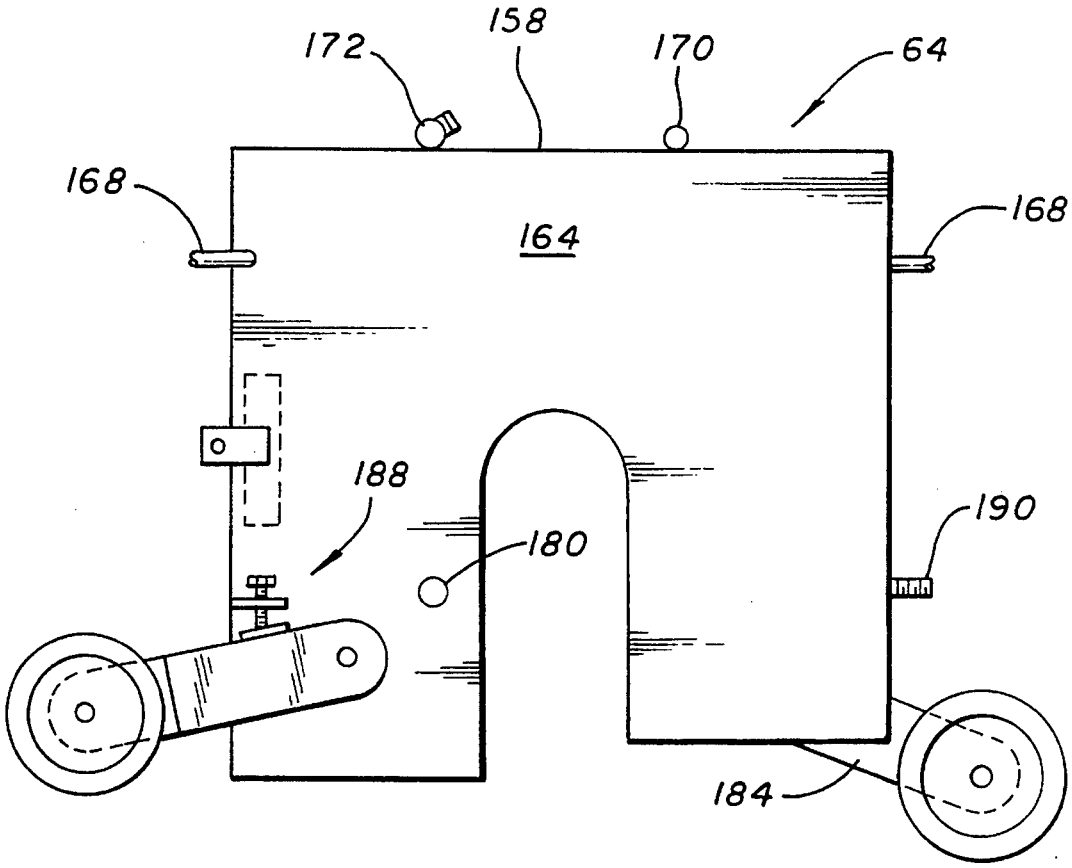
FIG. 8 is an inner side or left-side view of the blade guard of FIG. 5.
Figure 10:
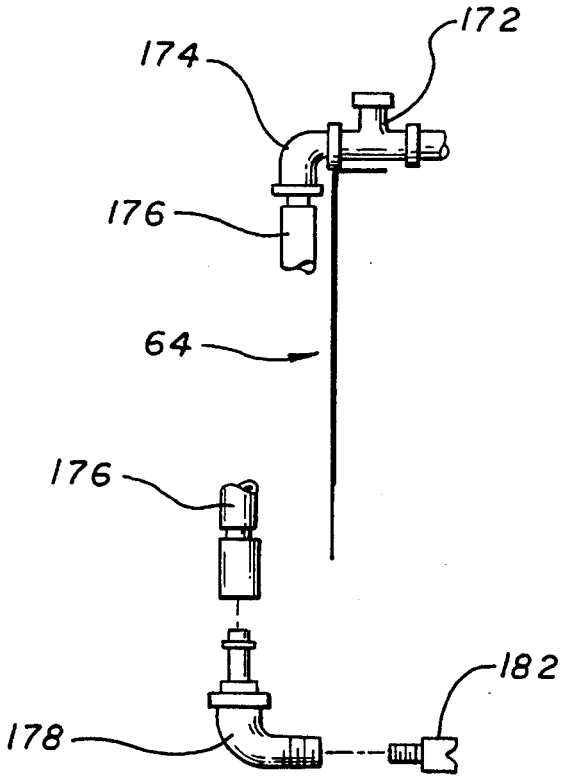
FIG. 10 is a front view of part of a coolant supply system on the blade guard of FIG. 5 for cooling the saw blade.

On the front inside surfaces of the inner and outer sides, a pair of back stops 198 are placed so as to provide support for the front side 162 of the blade guard. A retention bracket 200 is formed from oppositely positioned plates mounted to the outside surfaces of the inner and outer sides 164 and 166, respectively. The plates of the retention bracket include aligned holes for accepting a pin to retain the front side 162 on the blade guard, as represented in FIG. 6. The front side 162 includes a top flange 202 for resting on top of the top side 158 of the blade guard so that the front side can be supported on the blade guard by the top side 158. The front side also includes a diagonally positioned insert 204 welded in or near the junction between the top flange 202 and the front side 162 at an angle of 45 degrees. The diagonal insert 204 captures any water and debris which may be projected by the blade toward the front side. The length of the diagonal insert 204 may be 2½ inches, for example, to absorb the impact and redirect the water and debris. After hitting the diagonal insert 204, the water and debris will fall straight down simply by gravity at the front of the blade. The water and debris can thereafter be picked up by the vacuum system. Where the inside spacing between the inner and outer sides of the blade guard is two inches, the width of the front side 162 is preferably two inches to provide an interference fit between the adjacent surfaces and to provide a significant seal between the front side 162 and the adjacent side walls.

In the preferred embodiment, the lower approximately four inches of the 17½ inch front side is preferably formed of a rubber or other flexible panel 206 attached to the bottom of the front side 162. The flexible panel 206 redirects water which may run down from the front side 162 or which may drop from the diagonal insert 204 back toward the blade and vacuum system. The flexible panel reduces the amount of water which may be otherwise sprayed toward the front side and out from under the blade guard. The front side is removable so that a worn front plate can be replaced.

The blade guard provides for improved water containment, and decreases or breaks the centrifugal rotation of cooling water impelled by the speed of the cutting blade. The shape of the blade guard promotes movement of excess water simply by gravitation as the water falls down from the walls of the blade guard. As a result, the water does not hit the ground with any significant impact other than what may be created by the force of gravity. In conventional saws, the water hits the ground with relatively high impact and thereafter spreads across the pavement, and water and debris is also kicked back toward the machine and the operator because of the high force cause by the momentum of the water and slag. The blade guard of the present invention remains positioned over the blade regardless of the depth of cut for the blade, but is picked up with the blade guard support when the blade is one inch off the pavement. Additionally, the front cover of the blade guard can be easily replaced if wear occurs due to abrasion from the force of the water and slag.

The blade guard support allows the cutting blade to be lined up with the joint to be cut and allows the blade to go full depth while the guard is at all times set on the pavement so that the vacuum bar can remove water and other debris from the pavement as the blade is cutting. Additionally, the operator has a good view of the blade and its location relative to the pavement at all times.

The vacuum bar 68 (FIGS. 13–16) is supported by the blade guard and is held stationery relative to the blade guard by three upright plates. A mounting plate 208 extends upwardly approximately five inches and includes an upwardly extending U-shaped slot 210 into which the vacuum bar mounting bolt 190 extends and which forms the fastening means for holding the vacuum bar on the blade guard. The vacuum bar 68 is positioned laterally by a left plate 212 and a right plate 214 having their outer walls spaced apart from each other approximately two inches so that the blade guard fits down on the outside of each side of the left and right mounting plates 212 and 214. The left and right mounting plates extend upwardly inside the blade guard. The rear-most edges of the left and right mounting plates are spaced approximately ¼ inch from the forward-most face of the mounting plate 208 to form a gap 216 into which the rear side 160 of the blade guard is inserted. The bottom rear edges of the blade guard rest on the vacuum bar while the bottom forward edges of the blade guard extend forwardly adjacent a left V-arm 218 and a right V-arm 220. The left and right V-arms 218 and 220 of the vacuum bar 68 extend outwardly from the inner and outer sides 164 and 166, respectively, of the blade guard to pick up any water and slag which may pass outward of the blade guard under the sides of the blade guard.

The mounting plate 208 is positioned on the forward-most edge of the interleaved portion of the square tubes of the vacuum bar to form a vacuum manifold 222 in the vacuum bar. The vacuum manifold is substantially rectangular and supports a vacuum coupling 224 for applying vacuum to the vacuum bar 68 through the waste collection hose 88. The left V-arm and right V-arm of the vacuum bar extend straight rearward to form outer sides of the manifold. A left Chevron vacuum arm 226 and a right Chevron vacuum arm 228 join the respective V-arms at the sides thereof and have center lines joining the manifold at approximately a mid-point between the mounting plate 208 and the center of the vacuum coupling 224. A tail 230 forms the remainder of the vacuum manifold by extending forward between the straight portions of the V-arms up to the point where the two V-arms begin to diverge. The tail 230 extend rearward from the manifold along a centerline thereof, preferably aligned with the marked line 96 (FIG. 1) to pick up any slurry behind the blade.

The tubes of the V-arms and the tail are welded together to form the manifold. An opening is cut in the top to which the vacuum coupling is welded in order for proper air flow to occur. The underlying walls of the tubes may also be cut or removed, beyond the cutting for grooves or slots described below, to ensure adequate air flow from the arms of the tubes to the vacuum coupling 224.

The left and right V-arms of the vacuum bar pick up water and slag which flow on the pavement from the front and side of the blade guard. The left and right Chevron vacuum arms 226 and 228, respectively, pick up any excess water and slag which may have floated outside the left and right V-arms before the V-arms pass the particular location of the excess water, or which may have sprayed beyond the reach of the V-arms. The tail 230 serves to pick up any water and slag which may fall behind the saw blade and which may accumulate in the joint just formed by the cutting blade.

Grooves or slots 232 are formed in the bottom surfaces of the various portions of the vacuum bar to pick up the water and slag. The grooves are formed in the vacuum bar at the locations shown and with the relative length indicated in the bottom view of the vacuum bar with an approximately ⅛ inch width. The ends of the preferably four arms and the tail of the vacuum bar are closed. The grooves 232 in the Chevron arms pass from the Chevron arms through the bottoms of the V-arms forming the outer portions of the manifold and through the corresponding portions of the tail until the Chevron arm grooves meet the groove of the tail, the groove of the tail extending the entire length thereof. It is believed that grooves with a one-eighth inch width cut having the relative lengths shown in the drawing are appropriate for the vacuum bar formed from square tubing having approximately a one square inch internal cross-sectional area, along the arms and tail of the vacuum bar. For a 17½ inch overall length blade guard, it is believed that an overall length for the vacuum bar of approximately 25 inches is appropriate. Preferably, the V-arms extend approximately 18 inches forward from the mounting plate 208. The manifold is preferably approximately four inches long on each side, and the tail extends preferably seven inches from the rear face of the manifold. The Chevron arms are preferably 3½ inches long. The left V-arm 218 preferably extends forwardly and outwardly approximately ten inches at an angle of approximately 177 degrees to the manifold and then turns parallel to the center line of the vacuum bar for eight inches corresponding to the longer part of the blade guard. The straight portion of the left leg decreases the amount of splash and permits the inner side of the blade guard to sit inside that eight inch length of the left V-arm. In the preferred embodiment, the right V-arm extends 18 inches from the manifold at an angle of approximately 173 degrees. The Chevron arms preferably extend from the manifold at approximately 125 degrees. The length of the cuts in the left and right V-arms are approximately six inches for those cuts adjacent the ends of the V-arms, and two inches for those cuts formed intermediate the manifold and the ends of the V-arms. The center line of the two inch cuts are preferably positioned six inches from the forward portion of the manifold. The seven inch length of the tail is believed to prevent water run-out of excess water along the joint just cut by the blade. The cut formed in the tail of the vacuum bar is preferably aligned with the center of the blade. The arms and tail of the vacuum bar are preferably formed from one inch square tubing having a wall thickness of approximately ⅛ inch. One or more reinforcement walls 234 (FIG. 13) are preferably included to provide additional support for the mounting plate 208.

The vacuum bar conserves water and provides an effective and efficient method for removing water and slag from the pavement. The vacuum bar is easily retrofit onto existing saws and is easily adapted to existing saw designs. It is significant that adequate air flow is provided with the vacuum taken off the air intake on the engine and with the one inch cross-sectional area of the square tubing. It is believed that adequate air flow is provided to not only collect the water and slag but also to transport the slurry to the collection tank. The vacuum bar is preferably approximately ⅛ to 3/16 inch off the ground and the blade guard is preferably ¼ to ½ inch off the ground. The Chevron vacuum arms preferably extend in front of the front right saw wheel. It has been determined that the bearings on the front right saw wheel wear excessively because of the water and particulate debris contaminating the bearing. It is believed that the vacuum bar will decrease the wear experienced by the bearings on the right front saw wheel.

The vacuum coupling 224 is preferably slanted at 80 degrees from the top surface of the manifold in order to permit easy passage of the waste collection hose 88 past the body of the saw to the collection tank.

Figure 17:
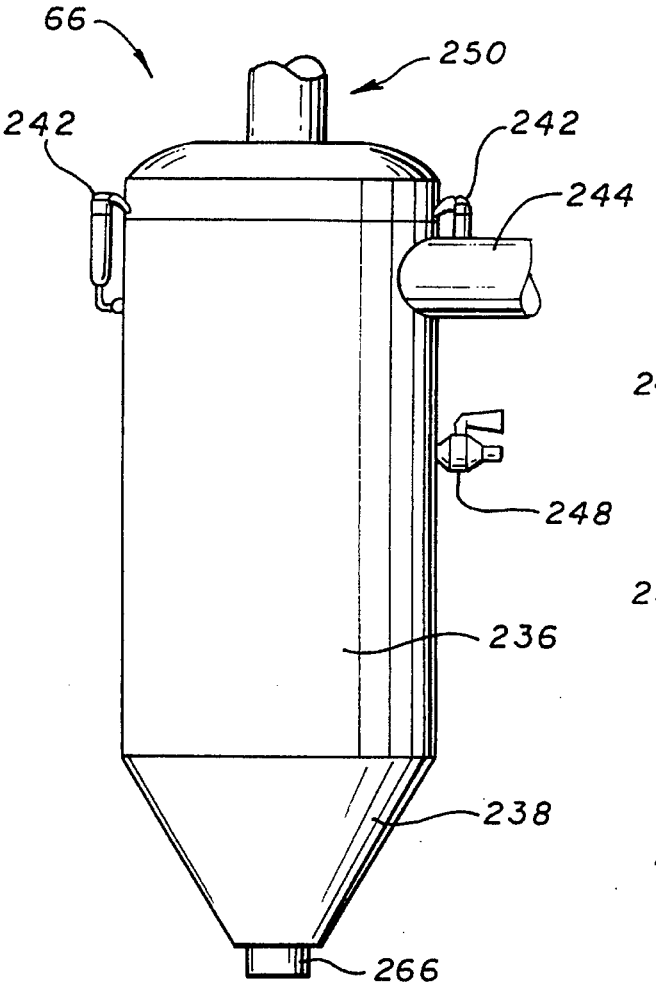
FIG. 17 is an outer or right-side view of a separator or collection tank in accordance with a further aspect of the present invention.
Figure 17A:
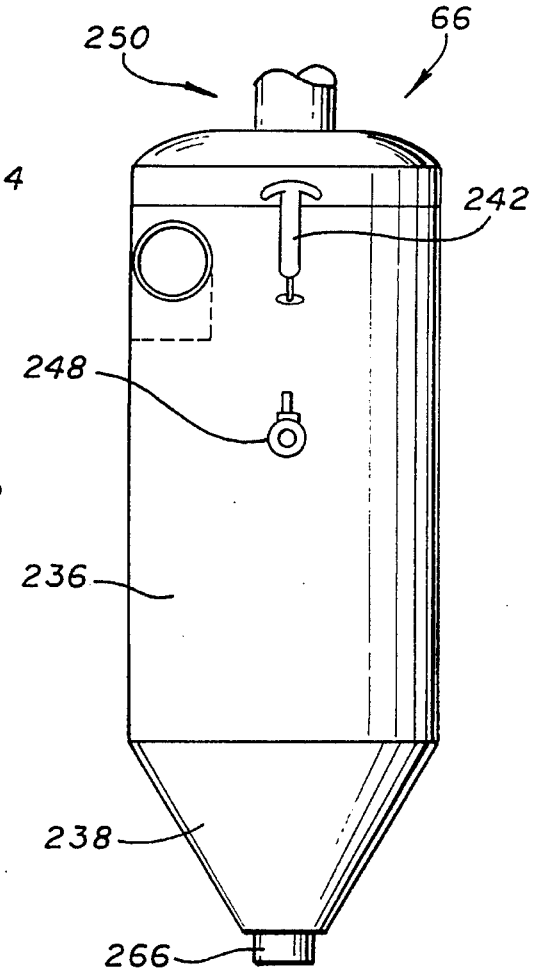
FIG. 17A is a side view of the tank of FIG. 17 rotated 90 degrees from the view shown in FIG. 17.
Figure 19:
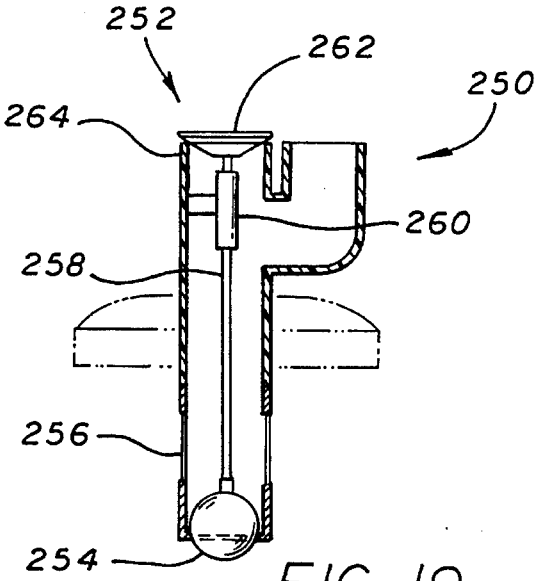
FIG. 19 is a schematic and partial side-sectional view of an overflow safety valve and vacuum manifold assembly mounted on the separator tank of FIG. 17.
Figure 18:
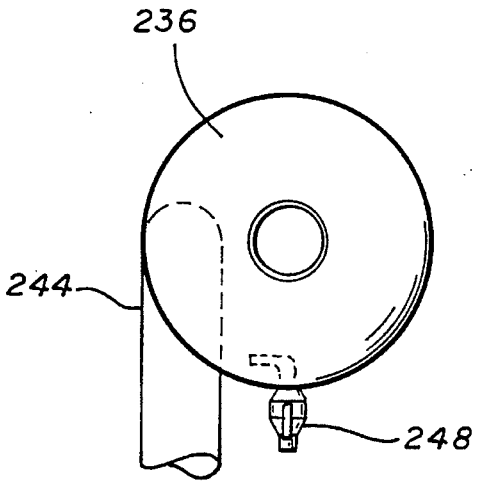
FIG. 18 is a top-plan view of the separator tank of FIG. 17.

The collection tank 66 (FIGS. 17–19) preferably includes a cylindrical section 236 and a conical section 238 at the bottom of the cylindrical section (or the bottom may also be flat) for collecting the water and slag solution. The collection tank also includes a cover 240 held on by appropriate clamps 242. To accommodate the preferably two inch inside diameter waste collection hose 88, a two inch outside diameter tubing 244 admits the water and slag solution into the collection tank and applies vacuum from the collection tank to the vacuum bar. The tubing 244 passes through the wall of the cylindrical section of the collection tank near the cover 240 and includes an internal rubber elbow 246 to serve as a baffle for directing the water and slag to the bottom of the collection tank, and to prevent any slurry from passing toward the cover 240. In the preferred embodiment, the collection tank includes a water valve 248 having a nozzle extending tangentially to the interior of the cylindrical section of the collection tank for directing a water stream around the inside of the tank for cleaning.

The cover includes a vacuum manifold 250 and an overflow valve 252. The vacuum manifold applies vacuum to the collection tank through a preferably two inch tubing coming from the air intake of the engine (FIG. 1), over the air manifold vacuum hose 116. The overflow valve 252 removes the vacuum by permitting air to enter the vacuum manifold if the liquid level in the collection tank reaches a selected level. The overflow valve 252 includes a float 254 retained in a float cage 256. The float 254 is held on a valve push rod 258 passing through the float cage 256 to and through a valve guide 260 to a valve 262 normally seated on a valve seat 264. The bottom of the conical section 238 preferably includes a one inch outlet 266 for removing the water and slag solution. The water and slag solution is removed from the outlet port 266 by the diaphragm pump and transported to the tender vehicle.

The collection tank and vacuum system provide a simple, efficient and easily applied and maintained waste recovery system. The vacuum system is adaptable to current saw designs and is easily retrofit to pre-existing saws. In one embodiment, one or more NAPA 6370 air cleaner elements may be placed in line between the vacuum manifold 250 and the air intake for the engine to minimize the possibility of air contaminants or moisture passing to the air intake of the engine. However, such filters are not essential.

A one inch waste removal hose 134 extends from the outlet port 266 of the collection tank to an input elbow 268 coupled to an input check valve 270 on the diaphragm pump assembly 104 (FIGS. 20–25). The inlet check valve, as well as the outlet check valve described more fully below, may include a two-to-one pipe bell reducer and a 1⅝ inch diameter weighted rubber ball to serve as the check valve. The rubber ball is preferably formed from a hollow rubber ball and weighted with, for example, a filler in the form of a hex nut and then filled with epoxy to stabilize the metal weight inside the rubber ball, giving a total weight for the ball of 3.5 ozs. A length of square tubing 272 extends from the inlet check valve 270 and forms a diaphragm pump body. The tubing 272 extends along a motor support 274, which also supports the diaphragm pump assembly. The square tubing 272 extends underneath a round diaphragm support plate 276, and to which it is welded, to an outlet elbow 278 and an outlet check valve 280. The elbow and outlet check valve 280 are preferably essentially identical to the inlet check valve. A preferably one inch pipe nipple 282 is coupled to the outlet check valve 280 for passing the waste material from the diaphragm pump assembly out the waste disposal hose 90 to the tender vehicle.

The diaphragm support plate 276 and the square tubing 272 are preferably welded together, after which a six inch by one and a half inch cut 283 forms the opening through which the diaphragm pump acts in order to pull the waste material from the collection tank and to push the material out to the tender vehicle.

The diaphragm includes a preferably eight inch diaphragm 284, such as a Bendex M-13773 air brake rubber cap which is retained about its edges on the diaphragm support plate by a tie down ring 286. The tie down ring is preferably mounted to the diaphragm support plate 276 by six equally spaced fasteners 288. The diaphragm may remained uncovered so that it can be visually inspected. The diaphragm is operated by a pump rod 132 mounted to the diaphragm by two four-inch diameter, ¼ inch thick flanges 292 for supporting the flexible diaphragm material.

The diaphragm pump provides a simple and efficient method of removing the water and slag solution from the collection tank and pumping it to a remote vehicle or other location. The diaphragm pump is easily controllable, and can be easily modified for different applications. The pump can easily accommodate transporting the water and slag solution. The diaphragm pump assembly is easily maintained and is easily inspected.

The eccentric bushing 130 (FIGS. 24A–C) is mounted to the motor shaft and retained in place by a key held by a set screw. The shaft includes an outboard bearing (not shown).

The eccentric part of the bushing is mounted through a bearing to the pump rod 132 for operating the pump.

The foregoing description represents preferred embodiments and may be easily modified while still coming within the scope of the intended invention. For example, the dimensions provided, and the descriptions of the relative sizes and configurations of the various elements can easily be changed and still achieve the purpose of the inventions. For example, the square tubing may have other configurations, the sizes and relative orientations of the various conduits and structures may be varied in accordance with the designs of the present invention.

What is claimed is:

1. A pavement treatment apparatus comprising:

a saw;

a liquid supply element for supplying liquid to cool the saw;

a motor for driving the saw;

a chamber for the drive motor within which a sub-atmospheric pressure exists during operation of the motor;

a vacuum element for removing material from the pavement treated by the saw; and a conduit for coupling the vacuum element to the chamber.

2. The apparatus of claim 1 wherein the saw includes a saw blade driven by the motor and the vacuum element includes a plurality of vacuum elements on each side of the saw blade.

3. The apparatus of claim 2 wherein the vacuum element includes a further vacuum element positioned behind the saw blade.

4. The apparatus of claim 1 further comprising a receiving tank coupled between the chamber and the vacuum element for receiving material from the vacuum element picked up from the pavement.

5. The apparatus of claim 4 wherein the receiving tank further includes a baffle wall for preventing material from passing from the collection tank to the intake chamber.

6. The apparatus of claim 5 wherein the receiving tank includes an outlet for removing material from the collection tank.

7. The apparatus of claim 6 further including a pump coupled to the tank outlet for removing the material from the receiving tank.

8. The apparatus of claim 7 wherein the pump includes a diaphragm pump.

9. The apparatus of claim 7 wherein the pump is operated through operation of the saw motor.

10. The apparatus of claim 9 wherein the pump is operated from a belt taken from a drive of the saw motor.

11. The apparatus of claim 9 wherein the pump is operated from a battery charged from the saw motor.

12. The apparatus of claim 4 wherein the receiving tank includes an overflow valve.

13. A pavement treatment apparatus comprising:

a pavement saw;

a motor for driving the saw;

a saw blade driven by the motor;

a water supply element for supplying water to the blade; and a vacuum element mounted on the saw and positioned on each side of the saw blade having first and second vacuum elements at least partially separated by the saw blade and extending on each side of the saw blade for removing material from the pavement.

14. The apparatus of claim 13 wherein the first and second vacuum elements extend on each side of the saw blade in a direction substantially parallel to the orientation of the saw blade.

15. The apparatus of claim 13 wherein the first and second vacuum elements extend substantially at an angle to the orientation of the circular saw blade.

16. The apparatus of claim 13 wherein the vacuum element includes a vacuum element extending behind the saw blade substantially in alignment with the cutting edge of the saw blade.

17. The apparatus of claim 13 wherein the vacuum element is mounted in a floating relationship relative to the saw such that when the saw is engaged with the pavement, the vacuum element maintains a substantially constant spacing relative to the pavement surface.

18. The apparatus of claim 13 further including a blade guard wherein the vacuum element is supported by the blade guard.

19. The apparatus of claim 13 wherein the vacuum element has at least one bottom surface and is formed from square tubular elements having walls in the bottom surface defining slits for removing material from the pavement.

20. The apparatus of claim 13 further comprising a blade guard and wherein the vacuum element includes first and second vacuum elements extending on opposite sides of the blade guard.

21. The apparatus of claim 20 wherein the blade guard includes straight side walls and a substantially straight front wall extending forwardly of a midportion of the saw blade.

22. The apparatus of claim 20 wherein the blade guard includes first and second side walls, a front wall and a rear wall, wherein the first and second vacuum elements are supported by mounting of the vacuum element to at least one wall of the blade guard.

23. The apparatus of claim 22 wherein the side, front and rear walls of the blade guard are substantially straight and wherein the front wall is substantially vertical.

24. The apparatus of claim 20 wherein the blade guard includes a substantially straight inner wall facing the saw and a substantially straight outer wall facing away from the saw wherein the first and second vacuum elements extend in a direction having a component parallel to the first and second walls of the blade guard and wherein the outer wall of the blade guard includes a surface defining an opening for viewing the blade during operation.

25. The apparatus of claim 13 further including a blade guard having a substantially vertical front wall removable from the blade guard.

26. The apparatus of claim 13 further comprising a blade guard having a front wall with a lower portion adjacent the pavement wherein the lower portion comprises a substantially flexible shield element.

27. The apparatus of claim 26 wherein the flexible shield element is dimensioned to extend below the lowest point of the blade guard.

28. The apparatus of claim 13 further including a blade guard having a front wall extending forwardly of the saw blade and further comprising an angled wall in the blade guard extending from the front wall at an angle rearwardly relative the front wall.

29. A pavement treatment apparatus comprising:

a saw with a saw blade;

a motor for driving the saw and for driving the saw blade; and a blade guard having at least two substantially flat rectangular sides for defining an enclosure for the saw blade and a rectangular front wall such that material from the blade during cutting hits the front wall.

30. The apparatus of claim 29 blade guard includes side front and rear walls and wherein the side, front and rear walls of the blade guard are substantially straight and wherein the front wall is substantially vertical.

31. The apparatus of claim 29 wherein the blade guard includes a substantially straight inner wall facing the saw and a substantially straight outer wall facing away from the saw wherein the first and second vacuum elements extend in a direction having a component parallel to the first and second walls of the blade guard and wherein the outer wall of the blade guard includes a surface defining an opening for viewing the blade.

32. The apparatus of claim 29 wherein the front wall is removable from the blade guard.

33. The apparatus of claim 29 wherein the front wall has a lower portion adjacent the pavement wherein the lower portion comprises a substantially flexible shield element.

34. The apparatus of claim 33 wherein the flexible shield element is dimensioned to extend below the lowest point of the blade guard.

35. The apparatus of claim 29 wherein the front wall extends forwardly of the blade and further comprising an angled wall in the blade guard extending from a point adjacent the front wall at an angle rearwardly relative to the front wall.

36. The apparatus of claim 29 wherein the blade guard further includes at least one wheel for supporting the blade guard on the pavement.

37. The apparatus of claim 36 wherein the at least one wheel is adjustable in position relative to the blade guard.

38. The apparatus of claim 29 wherein the blade guard includes an inner wall facing the saw and an outer wall facing away from the saw, and wherein the inner wall further includes a second wall defining an arched opening in the inner wall for positing the blade guard relative to the saw.

39. The apparatus of claim 38 further including a mount on the saw having an arched mount wall for engaging the arched opening in the inner wall of the blade guard such that the arched mounting wall moves the blade guard with the saw and such that the blade guard can float vertically relative to the mount.

40. The apparatus of claim 39 wherein the mount further includes first and second spaced apart walls joined by the arched wall for slidably sandwiching a wall of the blade guard.

41. A pavement treatment apparatus comprising:

a saw;

a motor for driving the saw;

an intake chamber for the drive motor within which a sub-atmospheric pressure exists during operation of the motor;

a vacuum element for removing material from the pavement around the saw; and a conduit for coupling the vacuum element to the intake chamber.

* * * * *